US006428157B1

(12) United States Patent
Wen

(10) Patent No.: US 6,428,157 B1
(45) Date of Patent: Aug. 6, 2002

(54) FORMING INK IMAGES HAVING PROTECTION FILMS

(75) Inventor: Xin Wen, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/325,077

(22) Filed: Jun. 3, 1999

(51) Int. Cl.[7] ..... B41J 2/01

(52) U.S. Cl. ..... 347/101; 347/20; 347/84; 347/85; 347/95; 347/103

(58) Field of Search ..... 347/101, 103, 347/84, 85, 86, 87, 93, 95, 96, 20, 21, 37, 6, 7, 8, 9

(56) References Cited

U.S. PATENT DOCUMENTS

| | | | | |
|---|---|---|---|---|
| 3,946,398 A | | 3/1976 | Kyser et al. | 346/1 |
| 4,217,409 A | * | 8/1980 | Inoue et al. | 430/346 |
| 4,723,129 A | | 2/1988 | Endo et al. | 346/1.1 |
| 5,549,740 A | * | 8/1996 | Takahashi et al. | 106/20 |
| 5,635,969 A | | 6/1997 | Allen | 347/96 |
| 5,766,398 A | * | 6/1998 | Cahill et al. | 156/240 |
| 5,792,249 A | * | 8/1998 | Shirota et al. | 106/31.27 |
| 5,975,680 A | * | 11/1999 | Wen et al. | 347/43 |

FOREIGN PATENT DOCUMENTS

| | | | |
|---|---|---|---|
| EP | 0285039 A2 | * | 5/1988 |
| EP | 0 062 251 A1 | * | 1/1994 |
| EP | 0827833 | | 3/1998 |
| WO | 98/08687 | | 3/1998 |

* cited by examiner

*Primary Examiner*—Andrew H. Hirshfeld
*Assistant Examiner*—Minh H. Chau
(74) *Attorney, Agent, or Firm*—Raymond L. Owens

(57) ABSTRACT

Apparatus for forming durable ink image in response to a digital image on a receiver, includes at least one ink jet print head adapted to deliver ink to the receiver and wherein the apparatus actuates the ink jet print head for delivering ink to the receiver to form an ink image in accordance with the digital image. The apparatus further includes a structure for applying a fluid over the ink image which forms a transparent solid continuous film for protecting the ink image.

9 Claims, 2 Drawing Sheets

FORMING INK IMAGES HAVING PROTECTION FILMS

CROSS REFERENCE TO RELATED APPLICATIONS

Reference is made to commonly assigned U.S. patent application Ser. No. 08/834,379, filed Sep. 19, 1997 entitled "Ink Jet Printing with Radiation Treatment" by Xin Wen and U.S. patent application Ser. No. 09/325,078 filed concurrently herewith, entitled "Apparatus for Forming Textured Layers Over Images" by Xin Wen, the disclosures of which are incorporated herein by reference.

FIELD OF THE INVENTION

The present invention relates to an ink jet printing apparatus for providing ink images with a protection film.

BACKGROUND OF THE INVENTION

Ink jet printing has become a prominent contender in the digital output arena because of its non-impact, low-noise characteristics, and its compatibility with plain paper. Ink jet printing avoids the complications of toner transfers and fixing as in electrophotography, and the pressure contact at the printing interface as in thermal resistive printing technologies. Ink jet printing mechanisms include continuous ink jet or drop-on-demand ink jet. U.S. Pat. No. 3,946,398, which issued to Kyser et al. in 1970, discloses a drop-on-demand ink jet printer which applies a high voltage to a piezoelectric crystal, causing the crystal to bend, applying pressure on an ink reservoir and jetting drops on demand. Piezoelectric ink jet printers can also utilize piezoelectric crystals in push mode, shear mode, and squeeze mode. EP 827 833 A2 and WO 98/08687 disclose a piezoelectric ink jet print head apparatus with reduced crosstalk between channels, improved ink protection, and capability of ejecting variable ink drop size.

U.S. Pat. No. 4,723,129, issued to Endo et al, discloses an electrothermal drop-on-demand ink jet printer which applies a power pulse to an electrothermal heater which is in thermal contact with water based ink in a nozzle. The heat from the electrothermal heater produces a vapor bubble in the ink, which causes an ink drop to be ejected from a small aperture along the edge of the heater substrate. This technology is known as Bubblejet™ (trademark of Canon K.K. of Japan).

U.S. Pat. No. 5,635,969 discloses a print head that conditions the ink receiver by ejecting a treatment fluid to the receiver before printing of the ink image on the receiver. The treatment fluid on the receiver helps to immobilize the ink pixels that are later printed on the receiver, which improves dot shape and thereby improving the quality and stability of the print.

Ink jet images often have problems associated with image durabilities. Image durability can include durability against physical abrasion, stability against water (i.e. water fastness), light fade (i.e. light fastness) and environmental conditions (oxidation etc.), and contamination such as fingerprints on the image. A traditional method for enhancing durability of ink jet images is to bond a lamination sheet on the ink image using a lamination machine. The lamination sheet is pre-coated with an adhesive layer. Pressure and heat are usually required to bond the lamination and the ink receiver together.

Several drawbacks exist with the lamination method. First, the lamination sheet significantly increases the cost of the media per unit area. Second, the lamination machine is expensive, sometimes more costly than the ink jet printer itself. Third, the lamination has the tendency to de-laminate over time or under physical or heat disturbance.

SUMMARY OF THE INVENTION

An object of this invention is to provide ink jet printing apparatus which produce ink images on receivers with enhanced image durability.

This object is achieved by apparatus for forming durable ink image in response to a digital image on a receiver, comprising:

a) at least one ink jet print head adapted to deliver ink to the receiver;

b) means for actuating the ink jet print head for delivering ink to the receiver to form an ink image in accordance with the digital image; and c) fluid ejection means for applying a fluid over the ink image which forms a transparent solid continuous film for protecting the ink image.

An advantage of the present invention is that a polymer protection film can be formed effectively with apparatus in accordance with the present invention with significantly reduced material and equipment costs.

Another advantage of the present invention is that lamination and associated drawbacks can be eliminated by forming a polymer protection film in accordance with the present invention.

Yet another advantage of the present invention is that the thickness and the area of the polymer protection film can be controlled by a computer and control electronics.

A feature of the present invention is that a polymer protection film is applied using an ink jet print head as a post-print step.

A further advantage of the present invention is that the application of the polymer overcoat film does not involve the contact of an applicator with the ink image, which reduces the probability of disturbing the ink images.

DETAILED DESCRIPTION OF THE INVENTION

The present invention relates to an ink jet printing apparatus which can provide improved durability in the ink images. In the present invention, the term "durability" refers to durability against physical abrasion, stability against water (i.e. water fastness), light fade (i.e. light fastness) and environmental conditions (oxidation etc.), and contamination such as finger prints on the image.

Figure 1:
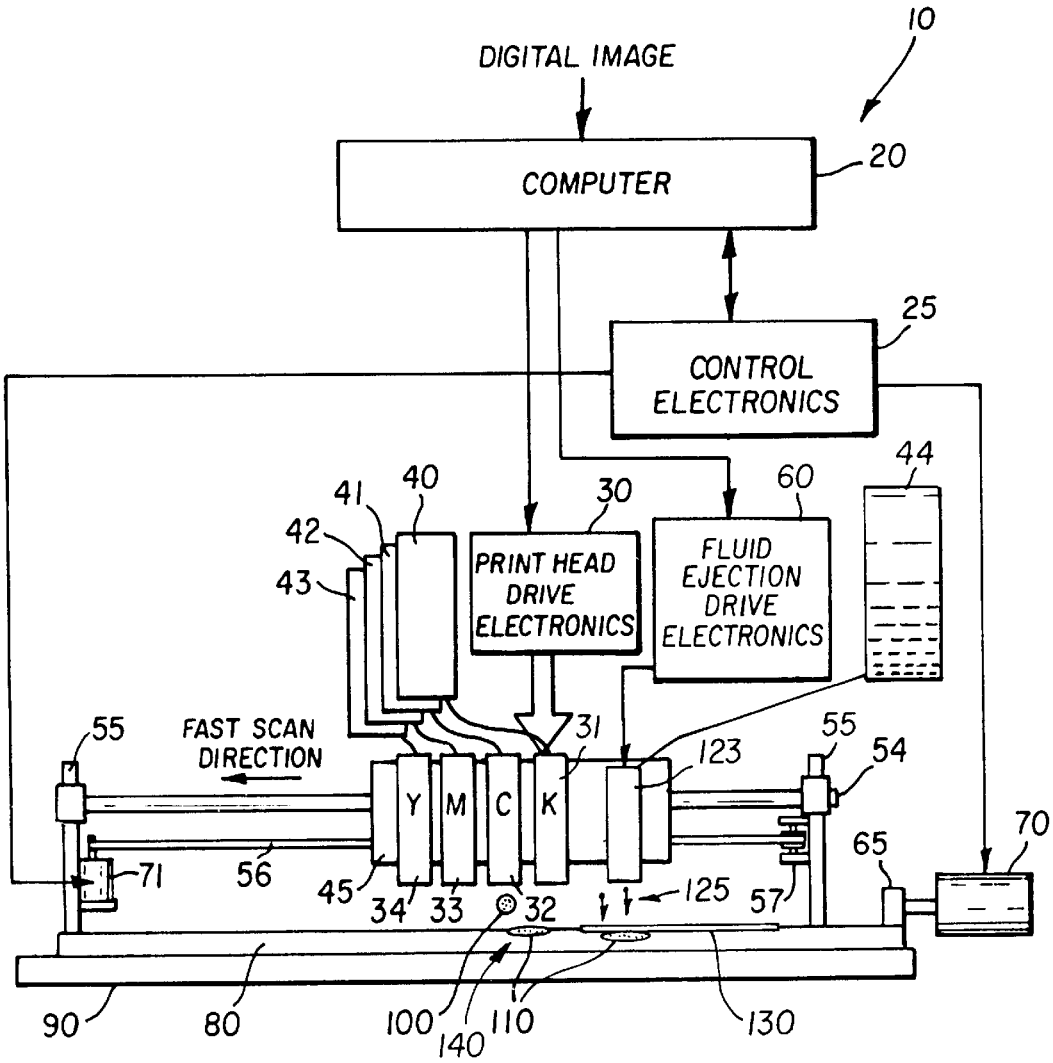
FIG. 1 is a schematic of an ink jet printing apparatus in accordance with the present invention.

Referring to FIG. 1, an ink jet printing apparatus 10 is shown to comprise a computer 20, control electronics 25, print head drive electronics 30, ink jet print heads 31–34 for printing black ink (K), cyan ink (C), magenta ink (M), and yellow ink (Y), and a plurality of ink reservoirs 40–43 for providing respective colored inks to the print heads 31–34. The print heads 31–34 are fixed to a holder 45 which can be translated by a print head translation motor 71 along the gliding rail 54 in the fast scan direction (as indicated in FIG.

1 by the arrow). The gliding rail is supported by supports 55. The print heads 31–34, a fluid ejection head 123, and the holder 45 are transported by several mechanisms, shown in FIG. 1. More specifically, there is shown a belt 56, a pulley mechanism 57, and the print head translation motor 71. The print head translation motor 71 can be a stepping motor, or alternatively can be a DC motor with a servo system. Although the fluid ejection head is a preferred embodiment, it will be understood that other arrangements such as an application roller, spray bar or wicking arrangement can also be used.

The ink jet printing apparatus 10 also includes a receiver transport motor 70, an ink receiver 80, and a platen 90. The receiver 80 is supported by the platen 90. The receiver transport motor 70 provides relative movement between the receiver 80 and the ink jet print heads 31–34 with a roller 65 that moves the receiver 80 in a slow-scan direction that is orthogonal to the fast scan direction. It will be appreciated that both the receiver transport motor 70 and the print head translation motor 71 are bi-directional so that the print heads 31–34, the fluid ejection head 123, and the receiver 80 can be transported back to the starting position.

The ink jet printing apparatus 10 further includes fluid ejection drive electronics 60 and the fluid ejection head 123, for transferring polymer fluids to an ink image, as described below. The fluid ejection head 123 contains a polymer fluid that is supplied by the fluid reservoir 44. The fluid ejection head 123 is preferably an ink jet print head, either thermal ink jet or piezoelectric, as described in the background of this application. When an ink jet print head is used, the polymer fluid is transferred over the ink image 140 in discrete ejected polymer fluid drop 125, in a similar fashion to ink jet printing. A polymer fluid overcoat film 130 is therefore formed on the ink receiver 80. The computer 20 controls the fluid ejection drive electronics 60 to determine the amount or the location of the polymer fluid applied on the ink receiver 80.

An advantage of the present invention is that the polymer overcoat does not involve the contact of an applicator (e.g. a contact roller) with the ink image. It has been found in the present invention that applying polymer fluid in contact with the ink image can disturb the ink image and cause a loss of image quality.

The polymer protection film can be formed uniformly over the whole ink receiver 80 or only on the part of the ink receiver where the ink image 140 (FIG. 3) needs to be protected. The usage of the polymer fluid can be minimized by applying the fluid only to areas where it is necessary.

In FIG. 1, the fluid ejection head 123 is held on the holder 45 and can be simultaneously moved by the same transport mechanism as the ink jet print heads 31–34. Alternatively, the fluid ejection head 123 can be mounted on a separate transport mechanism. The fluid ejection head 123 can also include a page-wide array of nozzles so that the relative movement between the fluid ejection head 123 and the receiver 80 is provided by the roller 65 moving the receiver 80 under the actuation of the receiver transport motor 70.

Figure 2:
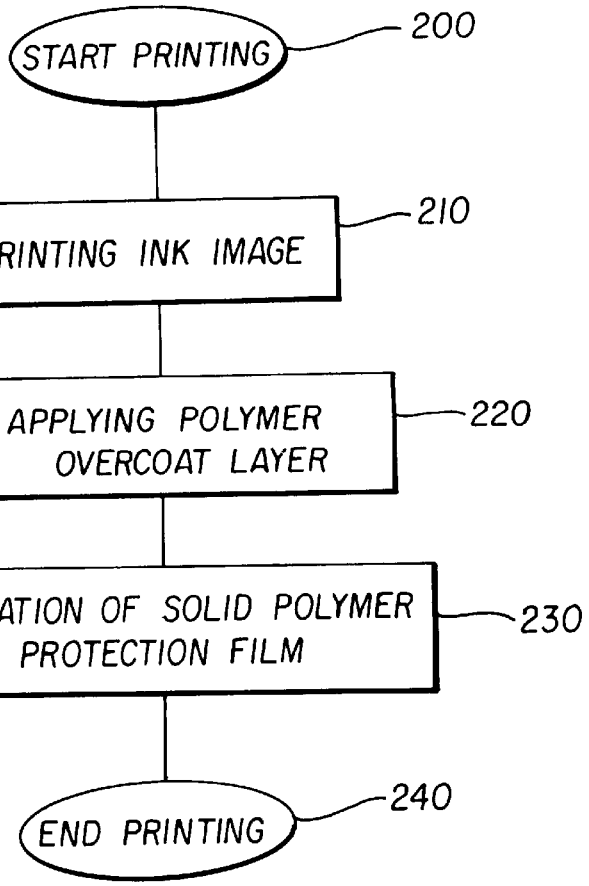
FIG. 2 is a flow diagram of operations of the ink jet printing apparatus in FIG. 1.

The operation of the ink jet printing apparatus 10 is illustrated in FIG. 2. After start printing (box 200), the ink image is first printed in box 210. An input digital image can be input to or produced in the computer 20. The digital image is processed in the computer 20 by image processing algorithms well known in the art, for example, tone scale calibration, color transformation, halftoning, ink rendering etc. The computer 20 sends the signals representing the digital image to the print head drive electronics 30 that prepares electrical signals for the print head 31–34 according to the digital image data. During each printing pass, the computer 20 controls the control electronics 25 to operate the receiver transport motor 70 and the print head translating motor 71. Under the control of the computer, the receiver 80 is positioned for a swath of image pixels to be formed and then the print head translating motor 71 moves the ink jet print heads 31–34 in a fast scan direction (shown in FIG. 1). The print head drive electronics 30 operates the ink jet print heads 31–34 to deliver ink droplets 100 to the receiver 80 to form ink pixels 110 on the ink receiving surface of receiver 80. An ink image 140 is formed by a plurality of ink pixels 110. Each ink image 140 is typically formed by a plurality of printing passes.

Next, in box 220, a polymer overcoat film is applied over the ink image formed on the ink receiver 80. The computer 20 controls the fluid ejection drive electronics 60, which determines the amount or the location of the polymer fluid applied on the ink receiver 80. The polymer fluid is transferred to the ink image 140 in discrete ejected polymer fluid drop 125 by the fluid ejection head 123. The fluid drops spread and coalesce with each other on the ink receiver 80 to form a continuous fluid polymer overcoat film 130 on the ink receiver 80. The time delay between the ejections of the ink drops 100 and the ejected polymer fluid drops 125 is controlled by the computer. Ink pixels 110 are well absorbed into the ink receiver 80 before the polymer fluid is applied.

Reviewing the operation of the ink jet printing apparatus 10, print head electronics actuates the print head 31–34 for delivering ink to the receiver at different positions for forming ink pixels 110 on the ink receiver 80 to form an ink image 140 in accordance with the digital image. The fluid ejection drive electronics 60 actuates the fluid ejection head 123 for applying polymer fluid over the pixels formed by the first ink jet print head so that the polymer fluid forms a solid transparent continuous polymer protection film 150 for protecting the ink image 140.

The polymeric fluid can be an aqueous solution, polymer dispersion, polymer suspension, or a polymer melt, such as a resin or latex solution. The polymers can include a single type of monomers, or co-polymers of more than one type of monomers. The co-polymerization can be blocked or randomized. As described below, the polymers can form a solid protection film when solidified by polymerization. The polymeric fluid can also include stabilizers, surfactants, viscosity modifiers, humectants, and other components. These additional components help the polymeric fluids to be effectively ejected out of the nozzles of the fluid ejection head 123, prevent the polymeric fluid from drying at the nozzles of the fluid ejection head 123, or assist the polymer fluids to properly coalesce over the ink image 140. Examples of the polymer fluids tested in the present invention are described below.

In the present invention, the ink images 140 were printed using thermal ink jet HP 1200 Professional Series Color printer and a piezoelectric ink jet Epson Color Stylus 900 printer. Kodak Inkjet Photo Paper, Epson Glossy Film, Quality Glossy Paper and Photo Paper are used on the Epson Color Stylus 900 printer. Kodak Inkjet Photo Paper, HP Premium Inkjet Glossy Paper, HP Premium Photo Paper and HP Photo Paper are used on the HP 1200 Professional Series Color printer.

An Epson Color Stylus 200 printer is used to deliver the polymer fluids. The polymer fluids are applied to the ink cartridge for the piezoelectric print head on the Epson Color Stylus 200 printer. A block of foam material is placed in the cartridge to hold the polymer fluid and dampen the fluid motion during printing. The polymer fluids can include 5% or 10% AQ polymer, or 2% polyvinyl pyridine, or 5% polyurethane in aqueous solution. Glycerol is also added to the polymer fluid as humectant at 5% concentration.

Ink images 140 were printed on receivers 80 using the Epson Color Stylus 900 printer and the HP 1200 Professional Series Color printer. The ink receivers 80 carrying the ink images 140 were fed into the Epson Color Stylus 200 printer. An image file was designed on a computer. The image included at least one area with a uniform density. The image file was sent to the Epson Color Stylus 200 printer. The polymer fluids as described above were delivered by the fluid ejection head 123 (that was piezoelectric print head) to form a wet polymer overcoat film 130 over the ink image 140 in accordance to the image file. The location and the thickness of the polymer overcoat film 130 were controlled by designing the image. For example, one or two monolayer coverage of the polymer fluid were overcoated on the ink image 140. Printing resolution (dot per inch), number of fluid ejection drops 125 per pixel, printing speed, drop volume for the delivery of the polymer fluids were also varied.

Figure 3:
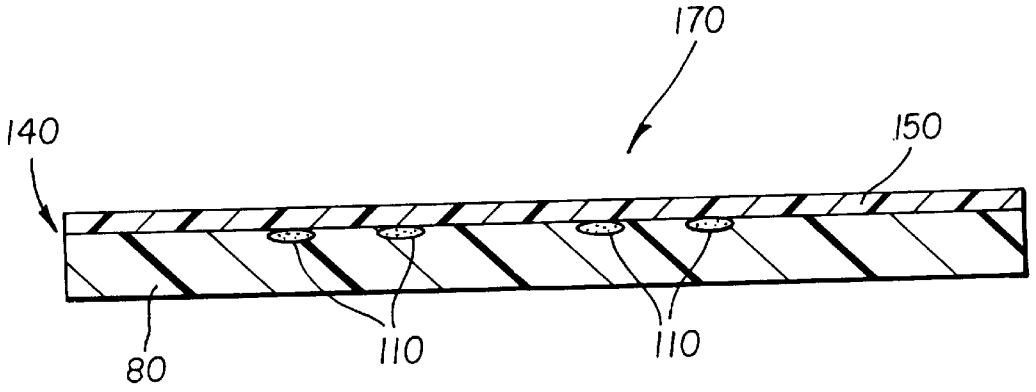
FIG. 3 is a cross-sectional view of a receiver having an ink image and a transparent solid polymer protection film formed by the apparatus in FIG. 1.

The formation of a solid polymer protection film 150 by the fluid polymer overcoat film 130 is shown in box 230. A finished ink image 170 is shown in FIG. 3. The ink image 140 comprises a plurality of ink pixels 110. After the application of the polymer overcoat film 130 in box 220, the fluid polymer overcoat film 130 is polymerized to form a transparent and solid polymer protection film 150 over the ink image 140. To properly protect the ink image against finger print, oxidation and abrasion, the polymer protection film 150 needs to be continuous over the area of the receiver 80 that needs to be protected. Strong chemical bonding is simultaneously formed between the polymer protection film 150 and the receiver 80. As it is well known in the art, the polymerization can occur through drying in the air, and/or with the assistance of heating or radiation. The solid polymer protection film 150 is transparent for viewing of the ink image. The polymer protection film 150 protected the ink images 140 on ink receivers 80 with enhanced image durability. Printing of the ink image and formation of the polymer protection film are shown as completed in box 240.

The thickness of the polymeric protection film can be varied by controlling the thickness of the polymer overcoat film 130 as described above. In the present invention, it is found that the polymer protection film 150 (FIG. 3) should be at least 0.5 micron in mean thickness, preferably, in the range of 1 to 10 microns, for providing appropriate ink image protection. It is found that satisfactory gloss can be provided by a smooth surface in the polymer protection film which can be achieved by uniformly delivering fluid ejection drops 125 over an area of the ink image 140. Uniformity of the fluid overcoat film 130 can be enhanced by increasing the number of printing passes over each area.

The polymer protection film 150 prevents the physical abrasion and environmental contamination on the ink image. The durability is therefore improved. Finger prints on the polymeric film can be easily wiped off. The chemical bonding between the film and the ink receiver also prevents the de-lamination problem associated with the lamination sheet in the prior art.

The invention has been described in detail with particular reference to certain preferred embodiments thereof, but it will be understood that variations and modifications can be effected within the spirit and scope of the invention.

PARTS LIST

10 ink jet printing apparatus
20 computer
25 control electronics
30 print head drive electronics
31 ink jet print head
32 ink jet print head
33 ink jet print head
34 ink jet print head
40 ink reservoir
41 ink reservoir
42 ink reservoir
43 ink reservoir
44 fluid reservoir
45 holder
54 gliding rail
55 support
56 belt
57 pulley mechanism
60 fluid ejection drive electronics
65 roller
70 receiver transport motor
71 print head translation motor
80 ink receiver
90 platen
100 ink drop
110 ink pixel
123 fluid ejection head
125 ejected polymer fluid drop
130 polymer overcoat film
140 ink image
150 polymer protection film
170 finished ink image
200 start printing
210 printing ink image
220 apply polymer overcoat film
230 formation of solid polymer protection film
240 end printing

What is claimed is:

1. Apparatus for forming durable ink image in response to a digital image on a receiver, comprising:

a) at least one ink jet print head adapted to deliver ink to the receiver;

b) means for actuating the ink jet print head for delivering ink to the receiver to form an ink image in accordance with the digital image; and c) fluid ejection means for applying a fluid over the ink image which forms a transparent solid continuous film for protecting the ink image;

wherein the ink jet print head and the fluid ejection means are both supported by a common holder associated with the actuating means such that the fluid ejection means can be moved across the receiver simultaneously with the ink jet print head.

2. The apparatus of claim 1 wherein the fluid is an aqueous polymer solution.

3. The apparatus of claim 1 wherein the fluid ejection means further includes fluid ejection drive electronics for controlling the application of the fluid over the ink image.

4. The apparatus of claim 1 wherein the fluid ejection means includes another ink jet print head.

5. The apparatus of claim 1 wherein the fluid is ejected in the form of discrete fluid drops.

6. Apparatus for forming durable ink image in response to a digital image on a receiver, comprising:

a) at least one ink jet print head adapted to deliver ink to the receiver;

b) means for actuating the ink jet print head for delivering ink to the receiver to form an ink image in accordance with the digital image; and c) fluid ejection means for applying polymer fluid over the ink image and wherein the polymer fluid forms a transparent solid continuous polymer protection film for protecting the ink image;

wherein the ink jet print head and the fluid ejection means are both supported by a common holder associated with the actuating means such that the fluid ejection means can be moved across the receiver simultaneously with the ink jet print head.

7. The apparatus of claim 6 wherein the polymer protection film has a thickness equal to or greater than 0.5 micron.

8. The apparatus of claim 6 wherein the polymer protection film has a thickness equal to or greater than 1 micron.

9. Apparatus for forming durable ink image in response to a digital image on a receiver, comprising:

a) a first ink jet print head adapted to deliver ink to the receiver and a second fluid ejection head for delivering polymer fluid to the receiver;

b) means for simultaneously moving the first ink jet print head and the second fluid ejection head across the ink receiver; and c) means for actuating the first ink jet print head for delivering ink to the receiver at different positions for forming ink pixels on the receiver to form an ink image in accordance with the digital image and for actuating the second fluid ejection head for applying polymer fluid over the pixels formed by the first ink jet print head so that the polymer fluid forms a transparent solid continuous polymer protection film for protecting the ink image.

* * * * *